United States Patent [19]

Goetz

[11] 4,062,708

[45] Dec. 13, 1977

[54] AZIDE GAS GENERATING COMPOSITION

[75] Inventor: George W. Goetz, Detroit, Mich.

[73] Assignee: Eaton Corporation, Cleveland, Ohio

[21] Appl. No.: 714,430

[22] Filed: Aug. 13, 1976

Related U.S. Application Data

[63] Continuation of Ser. No. 528,199, Nov. 29, 1974.

[51] Int. Cl.[2] ..... C06B 35/00

[52] U.S. Cl. ..... 149/35; 149/110

[58] Field of Search ..... 149/35, 110

[56] References Cited

U.S. PATENT DOCUMENTS

| | | | |
|---|---|---|---|
| 3,895,098 | 7/1975 | Pietz | 149/35 X |
| 3,996,079 | 12/1976 | DiValentin | 149/35 |

*Primary Examiner*—Stephen J. Lechert, Jr.
*Attorney, Agent, or Firm*—Alfred D. Lobo; Roger A. Johnston

[57] ABSTRACT

A relatively low temperature nitrogen gas generating composition is disclosed which consists essentially of (a) from about 10 to about 50 percent by weight of an oxidizer selected from the oxides of iron, nickel and cobalt, said oxidizer having a primary particle size in the range from about 0.1 micron to about 7 microns in diameter; and, (b) at least 50 percent by weight of an alkali metal azide. Optionally, less than about 10 percent by weight of an alkali metal perchlorate may be included as a booster. The nitrogen gas generating composition provides the nitrogen gas at a low enough temperature but at a sufficiently high speed, without generating a large quantity of finely divided solid residue particles. A major portion of the combustion residue is a coherent porous solid sinter or fused mass of residue particles which autogenously provides both self-filtration of ejected particles and sorption of any molten combustion product.

15 Claims, No Drawings

AZIDE GAS GENERATING COMPOSITION

CROSS-REFERENCE TO RELATED APPLICATION

This is a continuation, of application Ser. No. 528,199, filed Nov. 29, 1974.

This application is filed concurrently with Ser. No. 528,247 filed July 23, 1974 the disclosure of which is incorporated herein by reference, as if fully set forth.

BACKGROUND OF THE INVENTION

This invention particularly relates to a solid nitrogen gas generating composition useful as a nitrogen source for inflating an inflatable occupant restraint used to protect passengers in an automobile subjected to severe impact. Inflatable restraints are generally regarded as a preferred means for cushioning the impact of a passenger against the interior of the automobile and are especially effective when utilized in conjuction with safety belts. It is preferred that a solid gas generating composition be used as the source of the gas, because the volume required for storage of the solid is small, no high pressure container is required, and, desired characteristics of gas generation are more easily tailored for a solid composition. Moreover, a solid may be maintained in predictably good operating condition over an extended period of time with minimal expense, compared with a gas generating composition in any other form.

The many strick requirements of a solid gas generator composition for an inflatable restraint have been enumerated nearly as often as inflatable restraints have been discussed. For example, it is well known that a nontoxic gas must be generated in less than about 60 milliseconds in a large enough quantity to provide the necessary inflation, yet without destroying the bag. The temperature of the gas generated must be low enough so as not to burn the bag and inflict series injury on passengers who have been spared severe impact within the automobile.

Though the prior art is replete with numerous gas generating compositions, and particularly azide containing compostions to generate nitrogen, no gas generating composition has been suggested which yields upon ignition, a solid porous coherent sinter, hereinafter referred to simply as "sinter". By the term "sinter" I further describe a fused combustion residue which may be tailored for desirable physical and chemical characteristics, and predictably derived from a desirable nitrogen gas generating composition which fulfills the exacting requirements for an inflatable restraint. Formation of a porous sinter provides built-in self-filtration of products of combustion, and, for the relatively few particles which do attempt to escape, a simple retention system. The porous sinter reduces the stringency of demands imposed upon sophisticated filtration devices for confining explosively propelled particles of the combustion residue.

In particular, a prior art gas generating composition for inflating an inflatable confining means or occupant restraint is disclosed in German Offenlegungsschrift No. 2,325,310 laid open Dec. 6, 1973 wherein a gas generating solid mixture contains at least one substance which represents an alkaline earth metal azide, alkali metal azide or hydroxy metal azide of the general formula $M(OH)_m(N_3)_n$ in which M stands for magnesium, calcium, strontium, zinc, boron, aluminum, silicon, tin, titanium, zirconium, manganese, chromium, cobalt or nickel, m and n the valence of the atoms M, and m and n each time signify a whole number, as well as at least one oxidation agent and/or a combustible mixture which includes at least one oxidation agent and/or a reduction agent. Strontium azide is specifically preferred over alkali metal azides and particularly over sodium azide, because strontium azide is more easily decomposed, because of its lower decomposition temperature, and its smaller activation energy for decomposition. It is further stated that, where strontium azide is used, potassium perchlorate must be added in a quantity of about 5 percent by weight in relation to the quantity of strontium azide. Though, surprisingly alkaline earth metal azides are not known to form a coherent sinter when used as reactants in combination with the oxidation agents identified in the aforementioned German reference, more surprisingly, potassium perchlorate is not an essential ingredient in the gas generating composition of my invention. Among the oxidation agents disclosed in the aforementioned reference are various perchlorates, nitrates, metal peroxides, and metal oxides including ferric oxide, ferrous oxide and ferroso ferric oxide. The disclosed gas generating composition is contained in a chamber enclosed by a filtration wall composed mainly of several layers of closely woven metal wire gauze designed to trap finely divided particles of combustion residue. Specifically, the examples disclose that, upon ignition, essentially all the solid nitrogen gas generating composition is converted to a finely divided combustion residue, and, essentially all of this residue is trapped in the finely woven metal wire gauze layers fastened in the upper portion of a container. The gas generating composition was placed in the bottom of the container. Other examples reiterate that essentially all the solid gas generating composition is explosively converted to liquid and no coherent sinter is left.

Another prior art composition disclosed in U.S. Pat. No. 3,741,585 includes an alkali metal azide, a metallic sulfide, certain metallic oxides and sulphur to produce nitrogen at a temperature in the range from about 200° to about 1000° F. Metallic oxides disclosed are the oxides of molybdenum, tungsten, lead and vanadium. There is no indication as to the manner in which the combustion residue is contained nor of the physical form in which it is obtained.

To the best of my knowledge the prior art compositions do not yield, upon ignition, a solid, coherent, porous combustion residue. Instead, known compositions yield a fine hot powder of combustion residue particles, or liquid, which are carried in the gaseous product.

SUMMARY OF THE INVENTION

It has been discovered that an alkali metal azide in combination with an oxide selected from the oxides of iron, cobalt and nickel as oxidizing reactants, optionally boosted by an alkali metal perchlorate, provides a fast clean burn which generates nitrogen at a relatively low temperature, in the range from about 1350° F to about 2100° F, but in less that 100 milliseconds, yet leaves a combustion residue in the form of a solid porous coherent sinter.

It is therefore a general object of this invention to provide a solid nitrogen generating composition which upon ignition generates nitrogen without explosively spewing forth a shower of finely divided particles of combustion residue.

It is also a general object of this invention to provide a method for generating nitrogen using a solid gas generating composition which, upon ignition, provides autogenous filtration of combustion products, thus reducing filtration requirements conventionally provided by closely woven filter means to confine the combustion products.

It is a specific object of this invention to provide a gas generating composition for inflating a protective inflatable restraint with nitrogen gas to the exclusion of any other gas, rapidly and safely, without an explosive profusion of finely divided solid particles of combustion residue, or droplets of liquid combustion residue, so as to provide superior protection of the occupants of a vehicle in the event of a collision.

It is yet another specific object of this invention to provide an ignitable gas generating pellet as a source of nitrogen for an inflatable occupant restraint which pellet is formed by pelletizing a finely divided oxide of iron, cobalt and nickel having a primary particle size in the range from less than about 0.1 micron to about 10 microns to sustain a reaction upon ignition, the oxide being essentially homogeneously intermixed with a major quantity by weight of an alkali metal azide, and particularly a lower alkali metal azide selected from the azides of sodium and potassium; and, to control burn rate by controlling the primary particle size since smaller particles burn faster than larger particles.

It is a further specific object of this invention to provide a mass of densely packed pellets consisting essentially of an alkali metal azide and an oxide selected from the oxides of iron, nickel and cobalt, optionally in the presence of a booster charge of an alkali metal perchlorate, in such a manner that, after ignition, nitrogen is generated quickly at a temperature below the melting point of combustion products, and a coherent mass of pellet residues is obtained as a solid, porous, coherent, combustion residue.

It is a further specific object of this invention to provide a mass of ignitable, gas generating pellets of predetermined size, packed in a preselected packing configuration in such a manner that, upon ignition, desirable microscopic and submicroscopic gas passages are formed in the resulting sinter which autogenously provides a self-filtration action for the gas generated.

It is yet another specific object of this invention to provide a combustion residue in the form of a sinter consisting essentially of a solid, coherent, porous mass of fused particles which mass provides a dual function, namely, it filters those loose particles which would otherwise escape during generation of gas, and, the porous mass sops up or sorbs and holds any molten combustion product formed.

It is also a specific object of this invention to provide a process for generating essentially only nitrogen gas from a solid gas generating composition consisting essentially of an alkali metal azide and an effective amount of a stable oxide selected from the group consisting of oxides of iron, nickel and cobalt, by igniting the composition.

These and other objects, features and advantages of this composition and the method of its use will become apparent to those skilled in the art from the following description of preferred forms thereof and illustrative examples set forth herein.

DETAILED DESCRIPTION OF PREFERRED EMBODIMENTS OF THE INVENTION

The solid nitrogen generating composition of this invention may be used in any application where an inert nontoxic gas is to be produced in a very short period of time without the formation of other gaseous products. The speed of nitrogen generation is not equally cirtical in all devices requiring generation of an inert or nontoxic gas. For example, inflatable boats, rafts, escape ladders, and the like, may be inflated in several hundred milliseconds, but inflatable restraints deployed for use in passenger carrying vehicles must necessarily be inflated within less than 100 milliseconds, and preferably less that 60 milliseconds, to minimize the injuries to the passengers when a collision occurs. The preferred embodiments of the solid gas generating composition of this invention is specifically directed to inflatable vehicle occupant restraints. Inflatable restraints of this general type for the protection of a vehicle's occupant are disclosed in U.S. Pat. Nos. 3,573,885; 3,450,414; 2,834,609; and the like.

The gas generating composition of this invention comprises an alkali metal azide, preferably a lower alkali metal azide, and an oxidizing reactant for the azide selected from the oxides of iron, cobalt and nickel. In addition, the composition may optionally contain a booster such as an alkali metal perchlorate. Preferred alkali metal azides are the azides of sodium and potassium. More specifically, it is preferred that the alkali metal azide be the major constituent by weight of the gas generating composition present as a shaped mass, such as a pellet, formed by compacting a major amount of the azide interspersed with a minor amount of the reactant oxide. The size range of the finely divided azide is not critical, but it is preferred that an azide powder be used wherein the primary particle size is less than about 200 U.S. Standard mesh.

The reactant oxide may be any of the moisture-free oxides of iron, cobalt and nickel, the oxidation state of the element being relatively unimportant. However, since the gas generating characteristics of the composition of this invention must remain substantially constant over prolonged periods of storage, it is desirable that only the stable oxides of the elements be used. It is not necessary that the oxides of only one of the elements be used, and it may be desirable to utilize mixtures of the oxides of all three Group VIII elements, provided the oxides are essentially moisture-free. It will be expected that the precise gas generating characteristics of a particular solid composition will vary depending upon the particular reactant oxides used. Also, the amount of the oxide or oxides desirably used will vary depending upon the choice of reactant oxide.

It is essential, for inflation of an inflatable occupant restraint in less than 100 milliseconds, that the reactant oxide used be in the form of a subsieve size powder, less than about 10 microns in diameter and preferably having a primary particle size in the range from about 0.1 micron to about 7 microns in diameter. It is preferred that the oxide used be blended to form a homogeneous mixture with the alkali metal azide, and that the mixture of powders be compacted to form pellets of suitable size, preferably smaller than about 0.25 inch in nominal diameter. It has been found that particles having a primary size from about 1 $\mu$ to about 5 $\mu$ provide faster burning or ignitability than particles having a size close to about 10 $\mu$. Consequently desired changes in burning rates may be obtained by varying the particle size within the specified range.

A particularly effective pellet is one which is a short cylindrical shape having a diameter of about 0.125 inch and a length of about 0.25 inch. The length or shape of the pellet is not critical so long as it permits an effective packing configuration wherein each pellet is in contact with at least one other pellet in such a manner as to form a mass of packed pellets with interconnected cells and passages having a predetermined volume sufficient to permit gas to be evolved essentially as soon as it is generated. The density of an individual pellet is preferably in the range from about 150 to about 250 lbs. per cubic foot and the untamped bulk density of the pellets is in the range from about 50 to about 100 lbs. per cubic foot. The bulk density of a packed charge is in the range from about 60 lbs. per cubic foot to about 125 lbs. per cubic foot. Pelletizing of the powder is done in a conventional manner with the usual precautions for pelletizing a mixture of an alkali metal azide and a reactant metal oxide. Contamination of the pellets is held to a minimum to avoid affecting the gas generation characteristics of the solid composition. It has been found that the presence of the reactant oxide in a primary particle size larger than about 10 microns adversely affects not only the speed of gas generation but the cleanliness of the combustion reaction, and the formation of a sinter. Typically, pellets of this nitrogen gas generating composition are packed in a gas generator described more fully in co-pending U.S. Pat. application Ser. No. 528,247 filed July 23, 1974 filed concurrently herewith, and the disclosure of which is incorporated herein by reference.

For optimum results, it is necessary that at least a stoichiometric quantity of the reactant oxide be intermixed with the alkali metal azide. Particularly where the oxides of iron are used, it is preferable to utilize from about a 5 percent to about a 10 percent excess of reactant oxide to minimize the formation of free sodium. Larger excesses may be used but there is no economic justification for doing so since unreacted oxide behaves as an inert solid diluent. It has been found that where only nickel or cobalt oxides are used, a stoichiometric quantity suffices, no excess being necessary, and even less than stoichiometric quantities of cobalt oxide and nickel oxide are usable.

Since the pelletized mixture of alkali metal azide and reactant oxide is not hypergolic, it is necessary to have an initiator or ignitor present in the combustion chamber in order to initiate the process for generating nitrogen. The reaction is conveniently started by burning or otherwise igniting a small charge of conventional solid propellant igniter as in an electrical squib. Once the reaction has started the igniter is no longer necessary. A preferred form of an igniter may be any electrically activated squib constructed to ignite a confined charge of flash powder substantially instantaneously as is well known in the art. Any commercially available squib may be used such as is presently used in known inflatable devices. A particularly desirable squib having an electrical resistance of about 4.5 ohms is formed by surrounding an electrical bridge wire with an ignitable lead compound such as lead styphnate. An additional charge of another ignitable material may be included in the squib. Materials for the additional charge are preferably potassium perchlorate and barium nitrate. The casing of the squib is usually a crimpable metal such as brass, copper or aluminum. Aluminum is preferred as copper and brass tend to form unstable copper azide. Further details of the igniter and the system for igniting the pelletized mixture will be found in the aforementioned copending Pat. application Ser. No. 528,247 filed July 23, 1974.

Once initiated the stoichiometric reaction between an alkali metal azide and the reactant oxide may be represented as follows:

$$2MN_3 + R_xO \rightarrow M_2O + xR + 3\,N_2 \qquad \text{(I)}$$

where M represents an alkali metal, preferably sodium or potassium, R represents a reactant oxide of iron, cobalt or nickel, and x is a number which satisfies the valence requirement of a reactant oxide in its stable state.

Particularly with the oxides of iron, it is desirable to use at least a stoichiometric quantity as suggested by the first equation I. It is preferred to use a slight excess over stoichiometric, preferably about a 5 percent excess, but some liquid free alkali metal and liquid alkali metal oxide may nevertheless be formed. Where this does occur, it is found that the liquids formed during reaction are effectively sorbed, that is either adsorbed or absorbed, by the sinter left after ignition.

Surprisingly an excess of reactant oxide is unnecessary when nickel oxide or cobalt oxide is the only reactant oxide used. For reasons which are not presently clearly understood, even amounts of cobalt oxide or nickel oxide slightly less than the stoichiometric amount, i.e., about 95% of the stoichiometric amount required, appear to perform well. An even smaller proportion of reactant oxide may be used, for example, as little as 90% of stoichiometric, provided liquid sodium is not formed in an amount in excess of that which can be sorbed by the sinter without deleteriously affecting the cohesiveness of the sinter. Thus, when sodium azide is used, about 35 or 36 percent by weight $Ni_xO$ nickel oxide corresponds to a stoichiometric amount, depending upon the value of $x$ which is preferably in the range from about 0.75 to about 1.05.

When M represents sodium and R represents iron, the following reactions are known to occur:

$$4\,NaN_3 + Fe_2O_3 \rightarrow 2\,Na_2O.FeO + Fe + 6\,N_2 \qquad \text{(II)}$$

$$6\,NaN_3 + Fe_2O_3 \rightarrow 2\,Fe + 3\,Na_2O + 9\,N_2 \qquad \text{(III)}$$

$$Fe + 3\,Na_2O \rightarrow 2\,Na_2O.FeO + 2\,Na \qquad \text{(IV)}$$

The extent to which each reaction proceeds, and the relative facility with which each reaction proceeds, will be determined by numerous factors, and especially the relative quantities of ferric oxide and azide. For example, when about 38% by weight of the azide-reactant oxide mixture is ferric oxide, corresponding to stoichiometric amounts of reactants in equation II, very little liquid sodium is formed. When an excess of ferric oxide is present, say about 40% by weight of the mixture, essentially no liquid sodium is formed.

When a insufficient amount of ferric oxide is the only reactant oxide present, that is slightly less than that amount stoichiometrically necessary for the reaction represented by equation (II), a sorbable quantity of liquid sodium, not deleterious to the effective utilization of the gas generating composition, may be formed. However, when even a lesser amount of ferric oxide is the only reactant oxide present, for example, less than about 29% by weight of the mixture, which corresponds to stoichiometric amounts of reactants in equation (III), a deleterious amount of liquid sodium is formed, that is, more liquid sodium than can be sorbed by the sinter. Thus, where ferric oxide is the only reactant oxide used, at least 29% by weight ferric oxide is used.

In an analogous manner, a deleterious quantity of free alkali metal is formed if there is a sufficiently small amount of nickel oxide, or cobalt oxide. In general, to reduce or essentially eliminate the formation of free alkali metal, the amount of nickel oxide or cobalt oxide to be used should be greater than 90 percent, and preferably greater than 95 percent, of the stoichiometric amount theoretically required.

As can be seen from the above equations, the chemical reactions that produce the gaseous nitrogen also produce other products but these are not gaseous. The combustion products are left as a substantially solid sinter, with sufficient interconnected cells and passages to sorb and hold such liquid combustion products as may be formed, which is a unique feature of the composition of this invention. The oxides of iron cobalt and nickel are reactant oxides or sustaining oxidizers which generate nitrogen over the entire course of the reaction and result in the formation of a solid combustion product. Depending upon the particular ratio of the reactants, and the particular reactants chosen, a minor portion of the solid combustion product or sinter, preferably less than 10 percent by weight of the sinter may be molten after ignition.

The molten minor portion of the combustion residue may result from the formation of a small sorbable amount of molten alkali metal or alkali metal oxide, insufficient to deleteriously affect the cohesiveness of the combustion residue, as described hereinabove; or, from the formation of a small amount of molten alkali metal halide formed from an alkali metal perchlorate booster, if such a booster is used. The booster functions as an accelerating oxidizer compared with a reactant oxide which functions as a sustaining oxidizer.

The presence of the sustaining oxidizer dispersed throughout the structure of a pellet permits a burn, progressively throughout the mass of the pellet, quite unlike the surface burn of conventional propellants for example, those used in a rocket. The peculiar physical properties of the combustion residue permits escape of the gas generated without disintegration of the sinter. Sufficient sinter is formed to effectively hold the molten combustion products formed whether by capillary action or by adsorption on the surfaces of the sinter.

In addition to the intermixed alkali metal azide and Group VIII, Fourth Period reactant metal oxide it may be advantageous to use the alkali metal perchlorate booster either as an additional component of the pelletized mixture, or as a mass of crystals disposed in a layer of generally uniform thickness at the bottom of the packed charge of perchlorate-free pellets. The booster contributes to the speed of gas generation but results in the formation of alkali metal halide which may vaporize if the temperature of reaction is excessive. Moreover, an excessive quantity of booster is deleterious and is to be avoided both from the point of disintegrating the sinter, and because it forms an excessive amount of alkali metal halide, in excess of an amount sorbable by the sinter. Excess molten products escape from the sinter and may puncture the inflatable restraint. The amount of booster is preferably no more than 10 percent by weight of the gas generating mass of pellets. For example when potassium perchlorate is used as a booster, potassium chloride is formed as a reaction product.

The gas generating composition of this invention, whether or not boosted with an alkali metal perchlorate, will not ignite or change appearance when maintained at 75° C for 48 hours; will not explode or ignite when initiated with a #8 electric blasting cap; will not explode when ignited with a match or on a bed of kerosene-soaked sawdust, though it burns moderately; will not produce any spark or ignition though subjected to severe friction; and may be contacted with water without generating a substantial quantity of gas.

EXAMPLE 1

An ignitable nitrogen gas generating composition is formed by thoroughly mixing 70 gms. of finely divided sodium azide which passes through a 200 mesh sieve, and 36 gms. of subsieve ferric oxide powder having a primary particle size in the size range from about 1 $\mu$ to about 5 microns. The quantity of ferric oxide used is 5% over stoichiometric, that is 5% oxidizer in addition to the stiochoimetric amount. The composition is pelleted into cylindrical pellets having an average diameter in the range from about 4 mesh to about 14 mesh. The pellets are placed in a packed mass and ignited. Nitrogen gas is generated to the substantial exclusion of other gases and a solid porous coherent sinter is formed.

EXAMPLE 2

In a manner analogous to that described in Example 1 hereinabove, a mass of gas generating pellets is formed by pelletizing a mixture of 70 gms. sodium azide, 30 gms. ferric oxide, and with 4 gms. potassium perchlorate. The mass of pellets is then ignited. As before nitrogen gas is generated without an explosive profusion of particles of combustion residue. Again, as before, a sinter is formed, which upon examination is found to include potassium chloride.

In a manner analogous to that described in the foregoing examples nickel oxide and cobalt oxide are used at least in stoichiometric amounts, and generate a sinter, essentially free of molten alkali metal.

EXAMPLE 3

In a manner analogous to that described in Example I hereinabove, 70 gms. $NaN_3$ and 30 gms. $Ni_{0.885}O$ are intimately mixed and pelleted, either by compression or extrusion, to give pellets of desired shape and size. The amount of $Ni_{0.885}O$ represents about 5% less than the stoichiometric amount. The pellets are packed in a gas generator and ignited with a conventional squib. As before, nitrogen gas is generated while substantially all, and at least a majority of the particles of the residual ignition product are autogenously bonded together in a solid sinter which is easily permeable to the nitrogen generated. Essentially no molten sodium is found to have escaped from the sinter.

EXAMPLE 4

In a manner analogous that described in Example 3 hereinabove, 70 gms. $NaN_3$ and 30 gms. $Co_3O_4$ are intimately mixed and pelleted. The amount of $Co_3O_4$ represents about 2% less $Co_3O_4$ than the stoichiometric amount. As before, the pellets are packed in a gas generator and ignited. $N_2$ is generated without a noticeable back reaction indicating the substantial suppression of Equation IV.

Modifications, changes and improvements to the preferred form of the invention herein disclosed and described may occur to those skilled in the art who come to understand the principles and precepts thereof. Accordingly the scope of the patent to be issued herein should not be limited to the particular embodiments of the invention set forth herein, but rather should be limited by the advance of which the invention has promoted the art.

I claim:

1. A solid, ignitable, nitrogen gas generating composition consisting essentially of a major portion by weight of an alkali metal azide and enough finely divided reactant oxide selected from the oxides of iron, cobalt and nickel, to form upon ignition, a solid, porous, coherent combustion residue, without the formation of a deleterious guantity of a molten product of combustion, said reactant oxide being present as a subsieve powder having a primary particle size in the range from about 0.1 micron to about 10 microns.

2. The gas generating composition of claim 1 including, in addition, an alkali metal perchlorate booster in an amount less than about 10 percent by weight of said alkali metal azide and reactant oxide.

3. The gas generating composition of claim 1 wherein at least a stoichiometric quantity of an oxide selected from the oxides of iron is present.

4. The gas generating composition of claim 1 wherein said reactant oxide is selected from the oxides of nickel and cobalt.

5. The gas generating composition of claim 4 wherein said reactant oxide is present in an amount at least 90 percent by weight of stoichiometric.

6. The gas generating composition of claim 1 wherein said alkali metal azide is a lower alkali metal azide selected from sodium and potassium.

7. The gas generating composition of claim 6 wherein said alkali metal azide is sodium azide.

8. The gas generating composition of claim 1 wherein said nitrogen gas is generated to the substantial exclusion of other gases.

9. The gas generating composition of claim 1 wherein said gas is generated at a temperature in the range from about 1350° F to about 2100° F.

10. A nitrogen gas generating pellet consisting essentially of a major proportion by weight of an alkali metal azide intermixed with a minor proportion of a finely divided reactant oxide selected from the oxides of iron, cobalt and nickel, said reactant oxide being dispersed throughout said pellet to sustain generation of nitrogen gas to the substantial exclusion of other gaseous products.

11. The nitrogen gas generating pellet of claim 9 wherein said pellet, upon ignition, produces a solid, porous, coherent sinter having microscopic and submicroscopic interconnected cells and passages.

12. The nitrogen gas generating pellet of claim 9 including, in addition, less than 10 percent by weight of an alkali metal perchlorate.

13. An ignitable mass of nitrogen gas generating pellets packed in pellet to pellet contact in a predetermined configuration, wherein each said pellet consists essentially of a major amount by weight of an alkali metal azide and a minor amount of a reactant oxide selected from the oxides of iron, cobalt and nickel, said gas, upon ignition of said mass, being generated at a temperature in the range from about 1350° F to about 2100° F in less than 100 milliseconds, and said mass autogenously resulting in a solid, porous coherent sinter with microscopic and submicroscopic interconnected cells and passages which selectively permit essentially particle-free nitrogen gas to be evolved from said mass.

14. A solid, coherent, porous combustion residue or sinter useful as an autogeneously formed filter means for selectively releasing nitrogen gas generated therewithin, said sinter being formed as a reaction product obtained by igniting a major amount by weight of an alkali metal azide and a minor amount by weight of a finely divided reactant oxide selected from the oxides of iron, cobalt and nickel, and releasing nitrogen generated.

15. The solid, coherent, porous combustion residue or sinter of claim 13 formed in the presence of an alkali metal perchlorate as a booster.

* * * * *

UNITED STATES PATENT AND TRADEMARK OFFICE

CERTIFICATE OF CORRECTION

PATENT NO. : 4,062,708

DATED : 12-13-77

INVENTOR(S) : George W. Goetz

It is certified that error appears in the above-identified patent and that said Letters Patent are hereby corrected as shown below:

Col. 1, line 38: "series" should be "serious".

Col. 1, line 43: word "compositions" misspelled.

Col. 4, line 3: "cirtical" should be "critical".

Col. 5, line 67: "copending" should be "co-pending".

Col. 6, line 5: dots between $N_2$.....(I) were omitted.

Col. 6, line 41: dots between $N_2$.....(II) were omitted.
43: dots between $N_2$.....(III) were omitted.
45: dots between Na.....(IV) were omitted.

Col. 7, line 51: "pelletrized" should be pelletized".

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*